United States Patent [19]

Fiorini et al.

[11] Patent Number: 5,014,492

[45] Date of Patent: May 14, 1991

[54] PROCESS AND APPARATUS FOR CLOSING A FLEXIBLE TUBE AFTER FILLING

[75] Inventors: Roland Fiorini; Gérard Prayer, both of Sainte Menehould, France

[73] Assignee: Cebal, Clichy, France

[21] Appl. No.: 440,080

[22] Filed: Nov. 22, 1989

[30] Foreign Application Priority Data

Dec. 5, 1988 [FR] France ..... 88 17037

[51] Int. Cl.[5] ..... B65B 7/06

[52] U.S. Cl. ..... 53/405; 53/373; 53/434; 53/479; 53/512

[58] Field of Search ..... 53/79, 289, 405, 434, 53/469, 479, 481, 512, 403, 408, 486, 373

[56] References Cited

U.S. PATENT DOCUMENTS

| | | | |
|---|---|---|---|
| 2,161,071 | 6/1939 | McGrath et al. | 53/449 X |
| 2,339,896 | 1/1944 | Waters | 53/373 |
| 2,481,611 | 9/1949 | Moore | 53/373 |
| 3,381,441 | 5/1968 | Condo, Jr. et al. | 53/479 X |
| 3,469,364 | 9/1969 | Bischoff | 53/434 X |
| 3,491,803 | 1/1970 | Galik | 53/289 X |
| 4,120,134 | 10/1978 | Scholle | 53/469 X |
| 4,418,512 | 12/1983 | Johnson | 53/434 |
| 4,736,572 | 4/1988 | Fang et al. | 53/512 |
| 4,905,450 | 3/1990 | Hansen et al. | 53/469 X |

FOREIGN PATENT DOCUMENTS

| | | |
|---|---|---|
| 0251863 | 1/1988 | European Pat. Off. . |
| 621690 | 10/1935 | Fed. Rep. of Germany . |
| 1034093 | 7/1958 | Fed. Rep. of Germany . |
| 1091477 | 10/1960 | Fed. Rep. of Germany . |
| 363851 | 9/1981 | Fed. Rep. of Germany . |
| 2196313 | 4/1988 | United Kingdom . |

*Primary Examiner*—Robert L. Spruill
*Assistant Examiner*—Beth Bianca
*Attorney, Agent, or Firm*—Dennison, Meserole, Pollack & Scheiner

[57] ABSTRACT

The first object of the invention is a process for closing or sealing a flexible tube filled with a liquid, creamy or semi-pasty product (7), in which its skirt (2) is nipped below its open end so as to bring about a closure (10) allowing the escape of the air contained in the tube when the latter is transversely compressed and then after compression the closure (10) is transformed into a tight closure and the open end (17) of the tube is sealed. According to the invention, skirt (2) is nipped with elastically tightened parallel surfaces (10) and the skirt (2) is compressed to the right of the product contained (7), in such a way that the upper level of said product (7) remains below or at the lower limit of closure (10) and the end portion (17) of the tube (1) passing beyond said closure (10) is sealed, so as to avoid any pollution by the product deteriorating the seal. The second object of the invention is an apparatus for performing this process. The inventive process and apparatus apply to the conditioning of products in the food, cosmetics, pharmaceutical and hygienic fields.

12 Claims, 2 Drawing Sheets

PROCESS AND APPARATUS FOR CLOSING A FLEXIBLE TUBE AFTER FILLING

The invention relates to a process and apparatus for closing or sealing a flexible tube following its filling by the lower open end of the typically circular cylindrical skirt of said tube. The other end of said tube is surmounted by a tight distribution and/or plugging system.

It is known to tightly close or seal the lower end of the skirt of such a filled tube, e.g. using welding pliers. A small amount of air then remains within the tube, which can be accepted when there is a limited storage time prior to use or when the use leads to repeated contact between the product contained and the air. The problem becomes critical when the tube is surmounted by a distribution means without air return, i.e. not having any communication between the interior and exterior of the tube, such as a dosing pump, as described in European patent application EP-A-0251863. Tubes having such a dosing pump make it possible to avoid any deterioration over a period of time of products contained therein and which are sensitive to air, e.g. food or cosmetic creams, even during the use thereof and it is very desirable to eliminate or greatly reduce the amount of air which can be trapped by the closure of the skirt.

DE-B-1034093 more particularly describes a process for sealing the tube by nipping, squeezing or pinching the tube end in such a way as to expel the air, sealing by welding taking place within the nipped zone, via nipping means. This method does not make it possible to avoid the soiling of the surfaces to be welded by the product contained.

The Applicant has sought to develop a sealing process making it possible to avoid deterioration to the seal by the product contained and at the same time making it possible to obtain very low residual vacuums.

DESCRIPTION OF THE INVENTION

The first object of the invention is a process for sealing a flexible tube in which, after having filled it with a creamy or semi-pasty liquid product by the lower end of its skirt, said end is kept in the upper position, then its skirt is nipped below its lower or open end, so as to provide an incomplete seal permitting the escape of the air contained in the tube when the latter is transversely compressed, the tube skirt then being compressed at right angles to the product contained, said incomplete seal is transformed into a tight seal, the lower end of the skirt is sealed and the sealed tube is freed after removing the tube compression means, together with its closing and sealing means.

According to the invention, use is made of the following special measures:

(a) said skirt is nipped above the level of the product contained, the incomplete seal produced by said nipping action permitting the projection of a lower end portion, said nipping being carried out by means of elastically tightened parallel surfaces, the seal being obtained in the absence of an internal pressure and the air escape being obtained when the upper level of the product rises;

(b) the skirt of the tube is compressed at right angles to the product contained and remote from its nipped part, so as to locally reduce its internal cross-section and said compression is limited in such a way that the upper level of the product remains at the lower limit of or slightly below said incomplete seal;

(c) the lower end portion projecting beyond the incomplete seal and which has become the tight seal is sealed, thus avoiding any internal pollution of the skirt by the product leading to a deterioration of said seal.

The air contained in the tube is consequently completely or almost completely evacuated prior to the sealing of the lower end of the skirt. In the compression step (b), it is ensured that the product contained does not penetrate between the incomplete and then tight closing or sealing surfaces, because the soiling of these surfaces by the product would lead to a deterioration of the seal (e.g. welding or bonding) and could even lead to a leak. The position of the seal above the aforementioned sealing surfaces provides good security from this standpoint.

It is particularly advantageous to nip the tube skirt with elastically tightened, parallel nipping surfaces, the seal then being obtained in the absence of internal pressure and the air escape is obtained when the upper level of the product rises and its pressure increases as a result of this. The elastic tightening stress of these nipping surfaces is preferably chosen in such a way that the air escape only takes place for an internal pressure of the residual air above approximately five times atmospheric pressure, which then makes it possible to obtain both a very good air elimination and a guarantee of non-contamination of the seal by the product (=stopping of the free surface of the product at a certain distance from the nipping surfaces without any risk of passing beyond their lower limits). This tightening stress is consequently preferably between 10 and 120 kPa and in more preferred manner between 13 and 30 kPa.

This stress is exerted on the surface of the tightened tube i.e. in the case of an initially circular cylindrical skirt with rectangular nipping surfaces with the large sides perpendicular to the axis of the tube: $1.57 \times D \times H$, in which D is the diameter of the skirt and H the nipping height.

It is then possible to advantageously retain the same elastic tightening stress until and during the sealing of the skirt end above its nipping point.

In practice, the check to the rise of the product and its non-contamination of the skirt nipping and consequently optionally the interior of the sealed zone, is carried out by acting on the transverse compression dynamics (force or speed) and on the duration of said compression. Thus, it is both the checking of the final product level and the choice of the elastic tightening stress of the nipping action performed just above this final level which will accurately determine the very small residual air volume, e.g. less than 0.03 $cm^3$ at normal pressure.

The second object of the invention is an apparatus particularly adapted to the performance of the inventive process. This apparatus is suitable no matter whether the product to be conditioned is liquid, creamy or semi-pasty, i.e. in not very viscous pasty form. It can be used for supplementing all presently used flexible tube closing devices (welding, bonding, etc.). It can be adapted to all existing conditioning machines and can be used with any random existing filling means, provided that there is sufficient space on such machines and means.

As known from DE-B-1034093, this flexible tube sealing apparatus comprises:

A. means for holding the filled tube, the lower open end of its skirt being in the upper position;

B. means for evacuating the residual air in the tube prior to the final closure of said skirt, comprising:

(B1) nippers for keeping the lips of the tube closed, (B2) means for the transverse compression of the skirt of the filled tube at the liquid, creamy or semi-pasty product contained in said skirt, (B3) means permitting the escape of the residual air under pressure through said nippers and then the tight fastening of the latter;

C. means for the final sealing of the lower end of the skirt.

The special arrangements according to the invention are as follows:

(B1) said nippers have parallel tightening surfaces, which are elastically tightened, the levels of said surfaces being between the upper level of the product in the filled tube held by means (A) and the lower level of said final closure of the skirt;

(B2) said transverse compression means of the skirt of the tube at the product contained are remote from the nippers and act exclusively on the product contained as from the start of compression;

(C) said final sealing means perform the sealing of the end of the skirt above said tightening surfaces.

With these arrangements, during compression, the occluded air remains above the product contained and is progressively expelled through the nipped skirt portion, whereof the elastic tightening makes it possible to avoid any pollution by the product. The final closure or sealing of the skirt above its nipped portion consequently affects a skirt portion, whose non-pollution is guaranteed.

The final sealing means fixing the result, i.e. the absence or quasi-absence of residual air in the tube can already be in existence in the case where means A and B are adapted to or integrated into a preexistent conditioning means.

The nippers are provided with elastic tightening means, whose effects were described relative to the process. These elastic tightening means consist of at least one spring and at least one tightening means for said spring making it possible to regulate the tightening stress of the nipping surfaces of said nippers.

In particular for the mass conditioning of tubes, the apparatus is preferably provided with control means making it possible to automatically perform the succession of stages of the process according to the invention on each tube.

The following examples makes it possible to complete and illustrate the preceding description. The invention has very important advantages, namely:

the obtaining in series of very small residual air volumes in the flexible tubes, obtaining a final durable, guaranteed sealing effect, the underlying elastic closure not being soilable by the product contained and consequently:

very satisfactory keeping of air-sensitive products, reducing the problems linked with storage and improving the quality of the product and its regular nature for the consumer, no deterioration of an air-sensitive product in tubes equipped with a dosing pump with no air return, neither during storage, nor during distribution.

EXAMPLE

Figure 1:
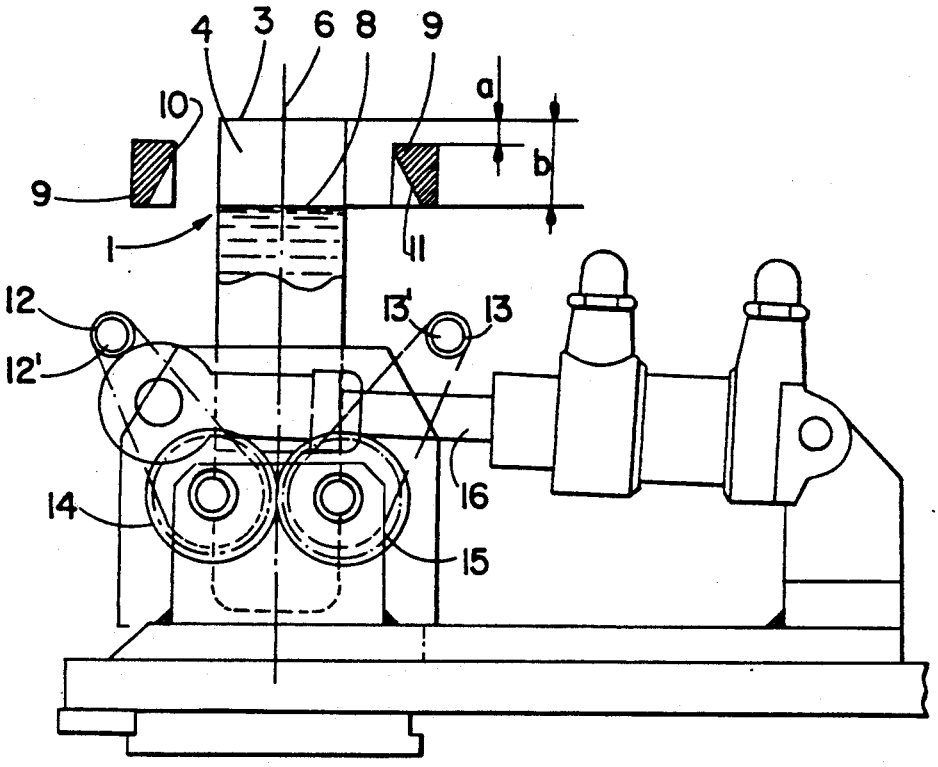
FIG. 1 shows in elevation an apparatus according to the invention with the skirt of a filled tube and incomplete closing nippers of said tube in a partial section along the tube axis.

The apparatus shown in FIG. 1 forms part of a conditioning assembly and more particularly a carrousel for filling the product and closing the tubes. This apparatus corresponds to one working station of said carrousel. The tube 1, whereof only the skirt 2 is diagrammatically shown, the edge 3 of the lower end 4 of said skirt 2 being in the upright position, is equipped with a not shown distribution means without air return. The tube 1 is maintained in the fixed position of its shoulder, so that its axis 6 is vertical. The tube 1 has been filled with a product in the form of a relatively fluid cream 7 and the upper level 8 of said cream 7 is 15 mm (distance b) from the terminal edge 3 of skirt 2. The apparatus comprises two nippers 9 for the end portion 4 of the skirt, the levels of their rectangular tightening or fastening surfaces 10 being between 5 and 7 mm (distance a) below the terminal edge 3 of skirt 2. These nippers 9 have inlet surfaces 11 inclined by 30° relative to the vertical, forming a 60° V when tightened.

The apparatus also comprises circular cylindrical rollers 12 and 13 making it possible to transversely compress tube 1 in its cream-filled portion 7. Their axes 12' and 13' are horizontal and parallel. They are connected to two toothed wheels 14 and 15, which mesh in such a way that the rollers 12 and 13 remain with the same from the axis 6 of tube 1. This spacing, i.e. the relative distance from the rollers 12 and 13 is advantageously controlled by a pneumatic or hydraulic jack 16, which is in this case pneumatic and which acts in an articulated manner on the arm connecting roller 12 to toothed wheel 14. In the starting position of FIG. 1, the rollers 12 and 13 are spaced from tube 1 and nippers 9.

Figure 2:
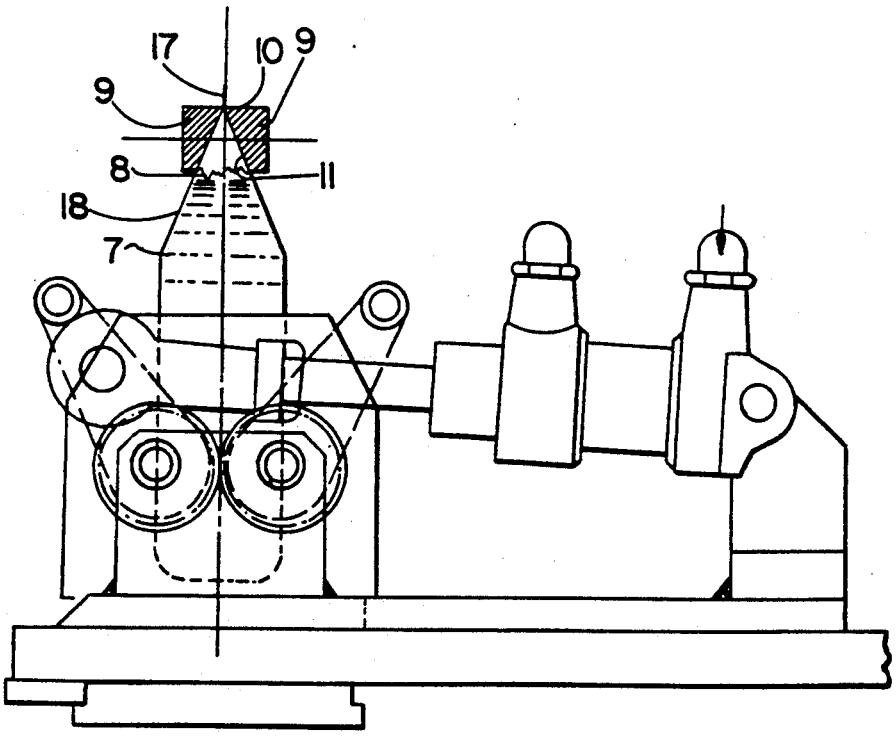
FIG. 2 shows the same apparatus in the same way, with the incomplete closing nippers being closed.

The nippers 9 are then tightened (FIG. 2), so as to produce between their tightening surfaces 10 a widened, flattened fold, which extends above said surfaces by an end portion 17, which will be used for the final sealing weld of the tube. The progressive crushing portion 18 of tube 1 bears on the inclined inlet surfaces 11 of nippers 9. The level 8 of cream 7 has risen and is still remote from the bottom of the tightening surfaces 10 of nippers 9. The tightening system generally designated as 90 for nippers 9 is elastic and "supple", it comprising a spring 91 and a nut 92 making it possible to regulate the tightening force (not shown). The surfaces 10 have a height of 2 mm and their tightening force is 15 kg (147N). As the skirt is of transparent polyethylene (PE) with a diameter of 30 mm, the elastic tightening stress obtained is 15.6 kPa. By placing in this new position, included air has been expelled, part of it through the elastic joint formed by the tightening surfaces 10 of nippers 9.

Figure 3:
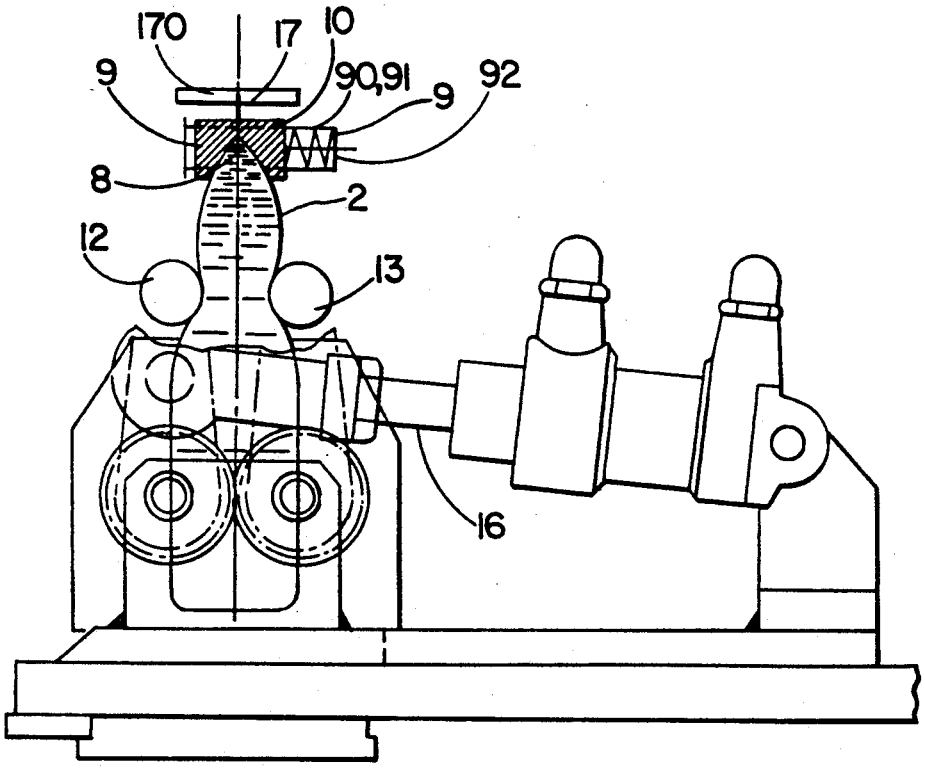
FIG. 3 shows the same apparatus, with the transverse compression means acting on the tube.

Once the nippers 9 have been tightened, tightening takes place of rollers 12 and 13 until the tube skirt 2 is compressed, so as to locally reduce its cross-section (FIG. 3) and therefore lead to an upward rise of cream 7. For this purpose the jack arm 16 has retracted. The compression time is determinative for the quasi-complete evacuation of the air contained in skirt 2 of tube 1, as well as for regulating the elastic tightening of the nippers 9 which has been carried out. This evacuation satisfies the imperative condition of not polluting the elastic joint 10 by cream 7.

On a series of tubes identical to tube 1 and filled with the same cream 7, compression was stopped when the level 8 of cream 7 was between 0.5 and 1 mm from the bottom of the joint 10 and the projecting end 17 of each skirt was welded with pliers 170, just above the tightening nippers 9. The residual air contained, calculated on the basis of the stopping position 8 of cream 7, was between 0.01 and 0.25 $cm^3$. Thus, in each case the tubes were freed following the welding of their end 17 and after moving from them the rollers 12 and 13 and the nippers 9.

INDUSTRIAL APPLICATION

The process and apparatus according to the invention are applicable to the conditioning of liquid, creamy or semi-pasty products in flexible packs and in particular tubes with a flexible skirt, in the food, cosmetics, pharmaceutical and hygienic fields.

What is claimed is:

1. Process for sealing a flexible tube filled with a creamy or semi-pasty liquid product, comprising the steps of:

disposing in an inverted position a tube skirt filled with said product to a predetermined level and open from the top of the tube as inverted;

nipping said skirt by elastically tightening parallel surfaces above the predetermined level so as to provide an incomplete seal which permits the production of an end portion projecting beyond the incomplete seal at the top of the skirt as inverted, and causes the upper level of the product in the tube to rise and air to escape, said seal being obtained in the absence of an internal pressure;

compressing said nipped skirt transversely to a longitudinal axis with respect to the skirt, and remote from the nipped portion, so as to locally reduce the internal cross-section of said skirt, said compression being limited such that the upper level of the product remains at a lower limit of or slightly below said incomplete seal;

tightly sealing the end portion projecting beyond the incomplete seal, avoiding any pollution of the skirt by the product leading to a deterioration of said tightly sealed end portion; and removing the compression of said skirt.

2. Process according to claim 1, wherein the elastic tightening of said nipping surfaces (10) and the transverse compression of the skirt (2) are chosen so as to reduce the possibility of wetting of said nipping surfaces (10) by the product (7).

3. Process according to claim 1 or 2, wherein the elastic tightening of said parallel surfaces (10) is at a stress of between 10 and 120 kPa.

4. Process according to claim 3, wherein said elastic tightening stress remains the same from the start of nipping to the sealing operation.

5. Process according to claim 3, wherein said stress is between 13 and 30 kPa.

6. Apparatus for closing and sealing a flexible tube filled with product, comprising:

(a) means for holding a filled tube skirt in inverted position with the upper disposed end of the tube skirt open;

(b) means for evacuating residual air in the tube skirt prior to final sealing of the skirt, comprising:

(1) nippers having parallel tightening surfaces and elastic tightening means for keeping the upper skirt end closed, said nippers being disposed at a level between the upper level of the product in the tube and the lower level of the final sealing of the skirt, said elastic tightening means permitting escape of residual air through the nippers and tight closing of the nippers; and (2) means for transverse compression of the skirt at the filled portion and remote from the nippers, acting exclusively on the product contained; and (c) means for final sealing of the upper disposed end of the skirt disposed above said parallel tightening surfaces.

7. Apparatus according to claim 6, wherein said elastic tightening means comprise at least one spring and a tightening means for said spring, making it possible to regulate tightening stress of the surfaces (10) of said nippers (9).

8. Apparatus according to claim 6 or 7, wherein said nippers (9) have inlet surfaces (11) together forming a bearing and centering V for the skirt (2).

9. Apparatus according to claim 6 or 7, wherein the compression means comprises two rollers (12, 13), with a regulatable spacing therebetween controlled by a pneumatic or hydraulic jack.

10. Apparatus according to claim 8, wherein the compression means comprises two rollers (12, 13), with a regulatable spacing there between controlled by a pneumatic or hydraulic jack.

11. Apparatus according to claim 9, wherein said rollers are cylindrical and circular.

12. Apparatus according to claim 10, wherein said rollers are cylindrical and circular.

* * * * *